US006098372A

United States Patent [19]

Focke

[11] Patent Number: 6,098,372

[45] Date of Patent: Aug. 8, 2000

[54] PACKAGING MACHINE WITH MOVABLE MEMBERS

[75] Inventor: Heinz Focke, Verden, Germany

[73] Assignee: Focke & Co. (GmbH & Co.), Verden, Germany

[21] Appl. No.: 09/179,681

[22] Filed: Oct. 27, 1998

[30] Foreign Application Priority Data

Oct. 28, 1997 [DE] Germany ..... 197 47 594

[51] Int. Cl.[7] ..... B65B 65/00

[52] U.S. Cl. ..... 53/234; 53/228; 493/476; 493/479; 493/910

[58] Field of Search ..... 53/234, 393, 228; 493/911, 910, 476, 478, 479, 480; 83/955, 522.27

[56] References Cited

U.S. PATENT DOCUMENTS

| | | | |
|---|---|---|---|
| 4,995,289 | 2/1991 | Bakermane | 83/955 X |
| 5,151,073 | 9/1992 | Focke | 493/910 X |
| 5,611,255 | 3/1997 | Evans | 83/955 X |
| 5,727,367 | 3/1998 | Cahill et al. | 53/389.3 X |

FOREIGN PATENT DOCUMENTS

| | | |
|---|---|---|
| 226 872 | 7/1987 | European Pat. Off. . |
| 361505 | 4/1990 | European Pat. Off. . |
| 2 590 231 | 5/1987 | France . |
| 35 45 884 A1 | 7/1987 | Germany . |
| 44 36 667 A1 | 4/1995 | Germany . |
| 195 21 476 A1 | 12/1996 | Germany . |
| 2 143 196 | 2/1985 | United Kingdom . |

*Primary Examiner*—James F. Coan
*Attorney, Agent, or Firm*—Sughrue, Mion, Zinn Macpeak & Seas, PLLC

[57] ABSTRACT

Apparatus, in particular packaging machine, with movable members which are exposed to wearing stresses on one side.

Primarily packaging machines for the manufacture of cigarette packs (10) of the soft-cup type employ folding mandrels (15), on which blanks (14) are temporarily fixed by means of pressure members, in particular by means of pressure rods (19). These are exposed to wearing stresses on one side, specifically in the region in which they bear on the folding mandrel (15). In order to avoid operating faults caused thereby, the pressure member, specifically the pivoting lever (20), is adjusted from time to time, specifically by partial rotation, so that, after a particular operating period, another circumferential region of the pivoting lever (20) is exposed to wearing stress.

12 Claims, 4 Drawing Sheets

PACKAGING MACHINE WITH MOVABLE MEMBERS

BACKGROUND OF THE INVENTION

The invention relates to an apparatus, in particular a packaging machine, with movable members which are exposed to wearing stress on one side or in a part region.

Machines and apparatuses of all kinds have stationary or movable members which, by virtue of their function, are exposed to increased wearing stress locally, specifically in a part region. One important example is a holding member or a pressure rod of a packaging machine for the production of cigarette packs, in which blanks of packaging material are temporarily fixed on a folding aid, specifically a so-called folding mandrel, by the holding member or pressure rod. The holding member, in particular the pressure rod, bears with a part region on the blank and, together with this, on the folding aid, specifically the folding mandrel. Due to the frequency of the work cycles, wearing stress is exerted on the movable holding member, specifically the pressure rod. The wearing stress is detrimental primarily when the holding member or pressure rod has bearing regions consisting of elastic material, for example a number of rubber rings arranged on the pressure rod at a distance from one another in the axial direction.

SUMMARY OF THE INVENTION

The object of the invention, in apparatuses of any kind, in particular in packaging machines, is to design movable members, which are exposed to wearing stress on one side or in a part region, in such a way that the adverse effects of material wear are eliminated or reduced.

To achieve this object, the apparatus according to the invention is characterized in that the movable member can be adjusted from time to time, in such a way that another part region is exposed to wearing stress.

The invention proceeds from the knowledge that wearing stress is unavoidable. However, instead of the member undergoing wearing stress being exchanged after a relatively short operating time, an (automatically controlled) adjustment of the relevant member is carried out, in such a way that another surface region of the latter is exposed to wearing stress.

The problem described arises especially in packaging machines for cigarettes, in particular for the production of cigarette packs of the soft-cup type. In packaging machines developed for this purpose, folding aids, specifically folding mandrels, are arranged on a folding turret. Blanks of packaging material are laid onto the outer face of these folding mandrels and are temporarily fixed by holding members, in particular, in each case, by pressure rods extending along the outer face of the folding mandrel in the longitudinal direction of the latter. These pressure rods bear temporarily on the folding mandrel in order to fix the blank. Wearing stresses thereby occur in the course of the multiplicity of work cycles. According to the invention, the holding member or the pressure rod is rotated from time to time in the circumferential direction, specifically through a relatively small angle of rotation, so that a non-stressed circumferential region of the pressure rod or of another cylindrical holding member acts as a pressure surface or pressure region. The same holding or pressure member can thus be used in a fully operational way over an operating period which is many times longer.

The invention proposes an automatically controllable actuating gear, with the aid of which the holding member can be adjusted or the pressure rod rotated through an angle. The gear is designed for a long-lasting reliable mode of operation.

Further details of the invention relate to the adjustment of a holding or pressure member, in particular to the regulating gear.

BRIEF DESCRIPTION OF THE INVENTION

An exemplary embodiment of the invention is explained in more detail below with reference to the drawings in which:

FIG. 1 shows a diagrammatic side view of a part region of a packaging machine for soft-cup packs, FIG. 2 shows a machine detail of the apparatus according to FIG. 1, specifically a folding turret, likewise in a simplified illustration, FIG. 3 shows a member of the folding turret, specifically a pressure rod, on a greatly enlarged scale, FIG. 4 shows the pressure rod in cross-section or in a transverse view in the press-down position, FIG. 5 shows, further enlarged, an actuating gear for the pressure rod in a side view or in radial section, FIG. 6 shows the gear according to FIG. 5 in a transverse view with a section through the pressure rod.

DESCRIPTION OF A PREFERRED EMBODIMENT

Figure 1:
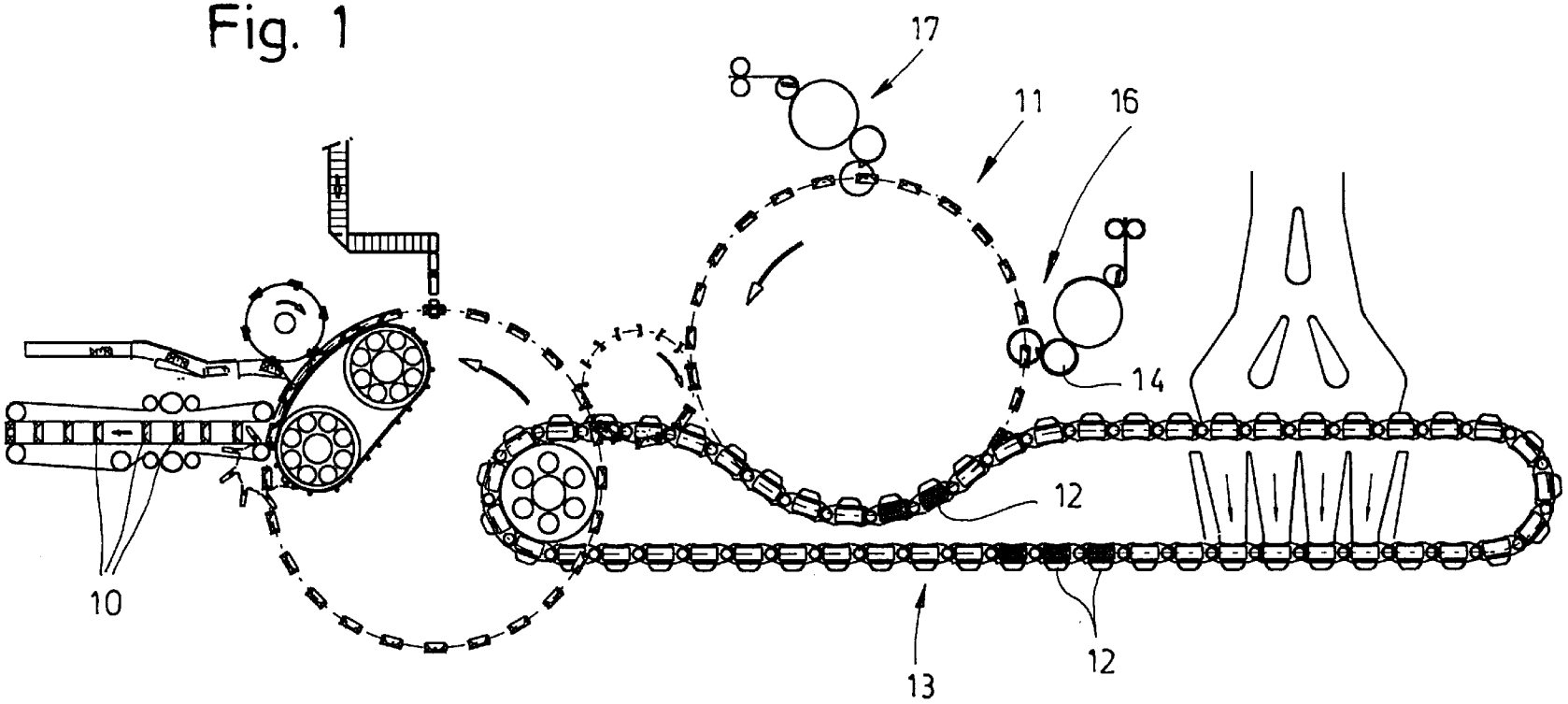

The exemplary embodiment illustrated in the drawings is concerned with a packaging machine for the manufacture of cigarette packs 10 of the soft-cup type. The packaging machine, described in detail elsewhere, has a folding turret 11. Cigarette groups 12 are fed to this folding turret by means of a pocket chain 13. The cigarette groups 12 are wrapped, in the region of the folding turret 11, in a first, inner blank 14 which conventionally consists of paper or tin foil. Furthermore, an outer wrapping, specifically a cup consisting of a paper blank (not shown), is attached.

In order to wrap the cigarette groups 12, the folding turret 11 is provided, along the circumference, with a multiplicity of receptacles, arranged at distances from one another, for cigarette groups 12, specifically with elongate folding mandrels 15. These are thin-walled hollow bodies which are open at both ends. The cigarette group 12 is pushed into the folding mandrel 15 in the longitudinal direction. The blank 14 (inner wrapping) and a paper blank for the soft cup are folded in succession on the outer face of the folding mandrel 15. The unit consisting of the folded blanks 14 and of the cigarette group 12 is then jointly pushed out of the folding mandrel 15 or drawn off from this in the longitudinal direction.

For the folding operation, while the folding turret 11 is moving continuously in rotation, individual blanks 14 are kept ready in each case in the region of a first and a second blank station 16, 17 and are introduced into the circular path of the folding mandrels 15. At the same time, the blanks 14 are in each case positioned in such a way that a (narrow) side wall 18 of the folding mandrel, the said side wall being at the front in the direction of rotation of the folding turret, grasps a blank 14. The blank is then laid, U-shaped, onto the folding mandrel 15.

The blank 14 is temporarily fixed on the outer face of the folding mandrel 15 in each case by holding members, specifically until folding steps have ended. In the present exemplary embodiment, each folding mandrel 15 is assigned a pressure member, specifically a pressure rod 19, arranged on the folding turret 11. This pressure rod extends adjacently to the side wall 18 of the folding mandrel. At least one pressure rod 19 is therefore positioned in each case, as a holding member, between the circumferentially adjacent folding mandrels 15.

Figure 2:
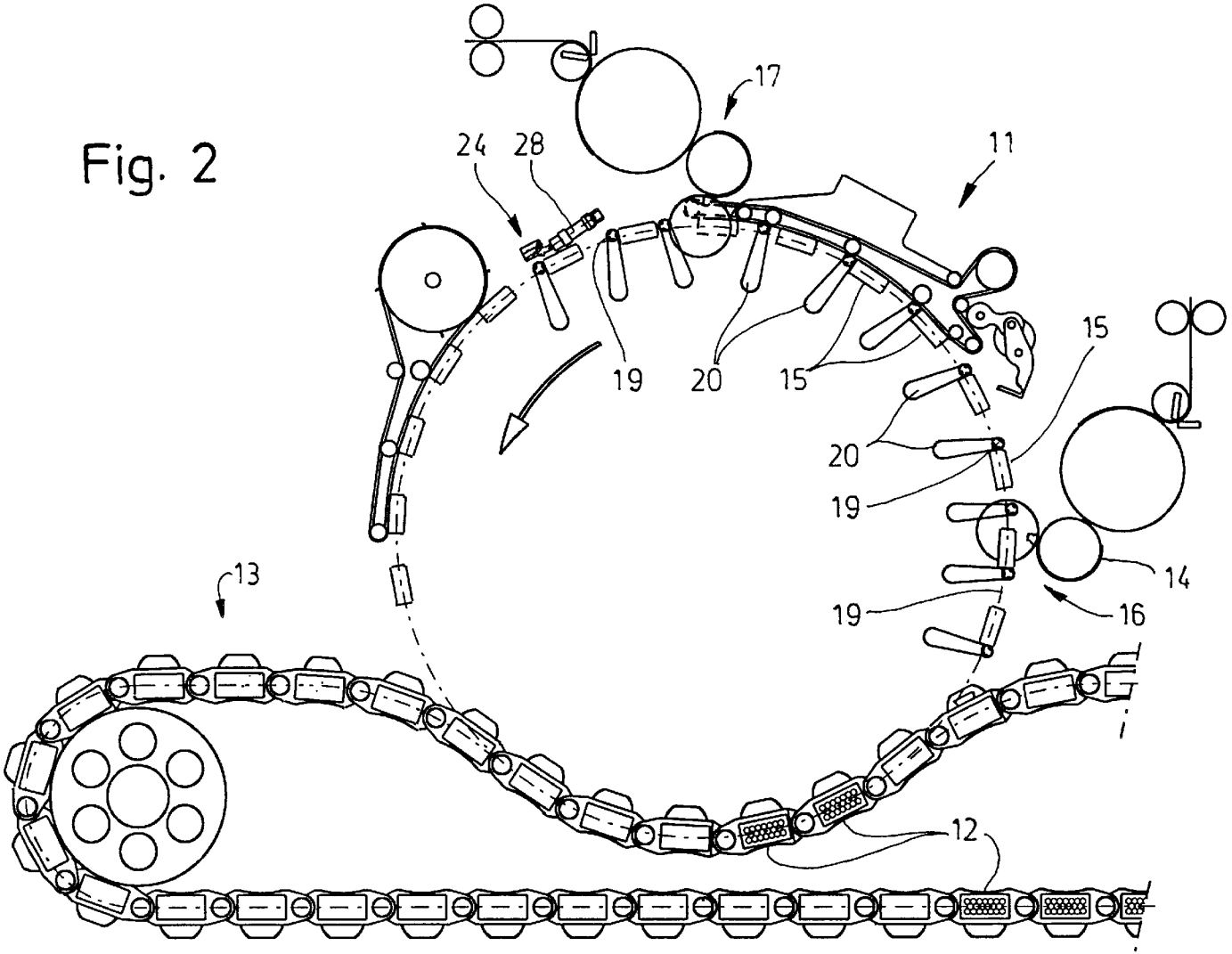
Figure 3:
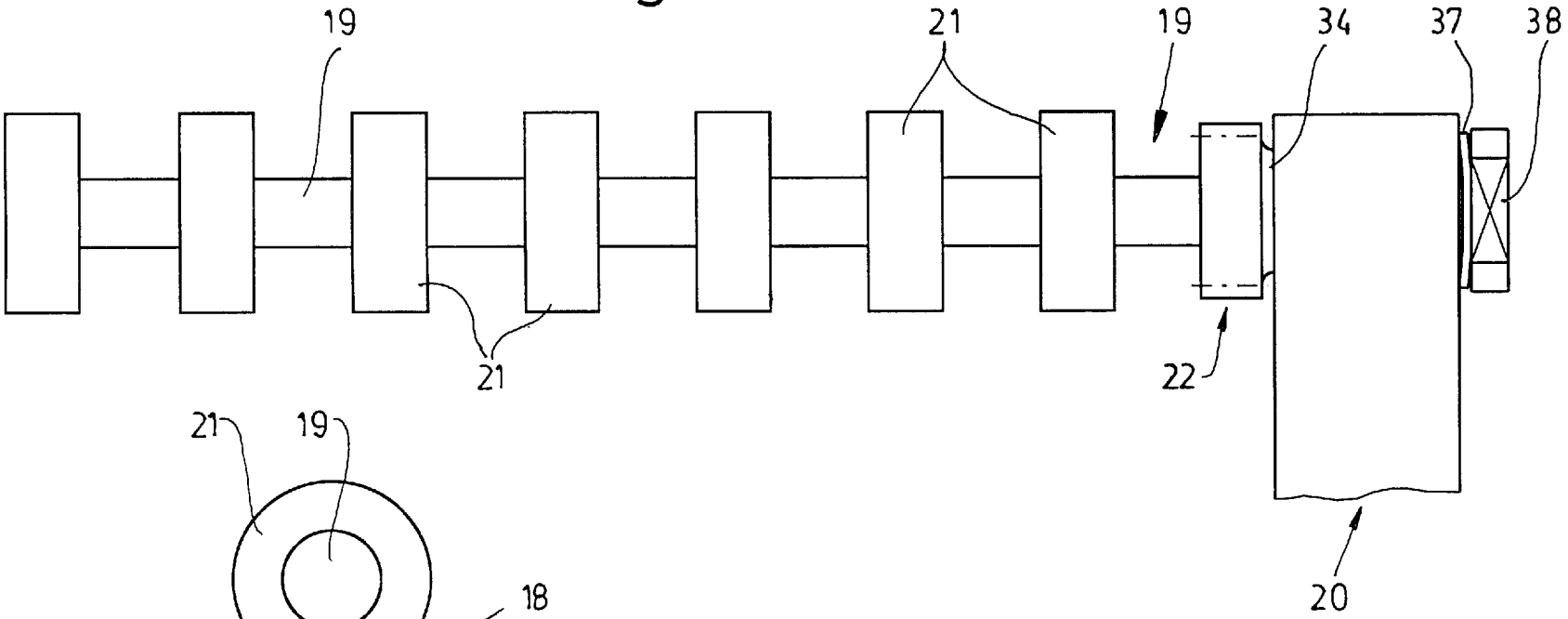
Figure 4:
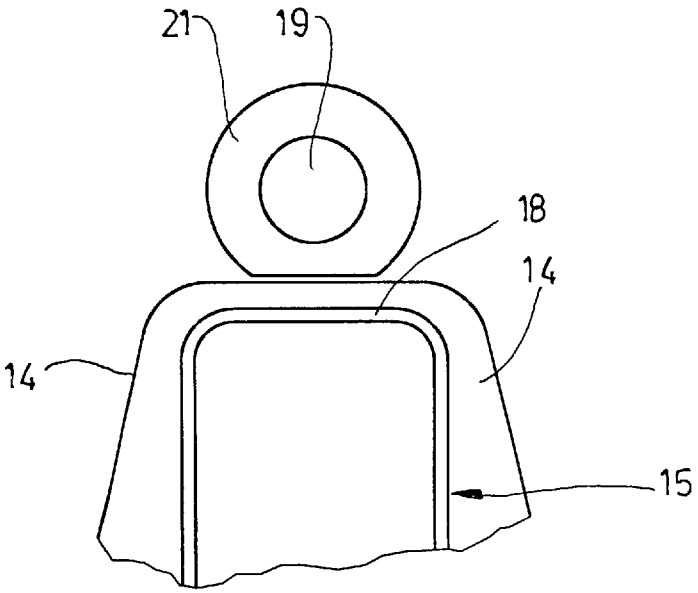
Figure 6:
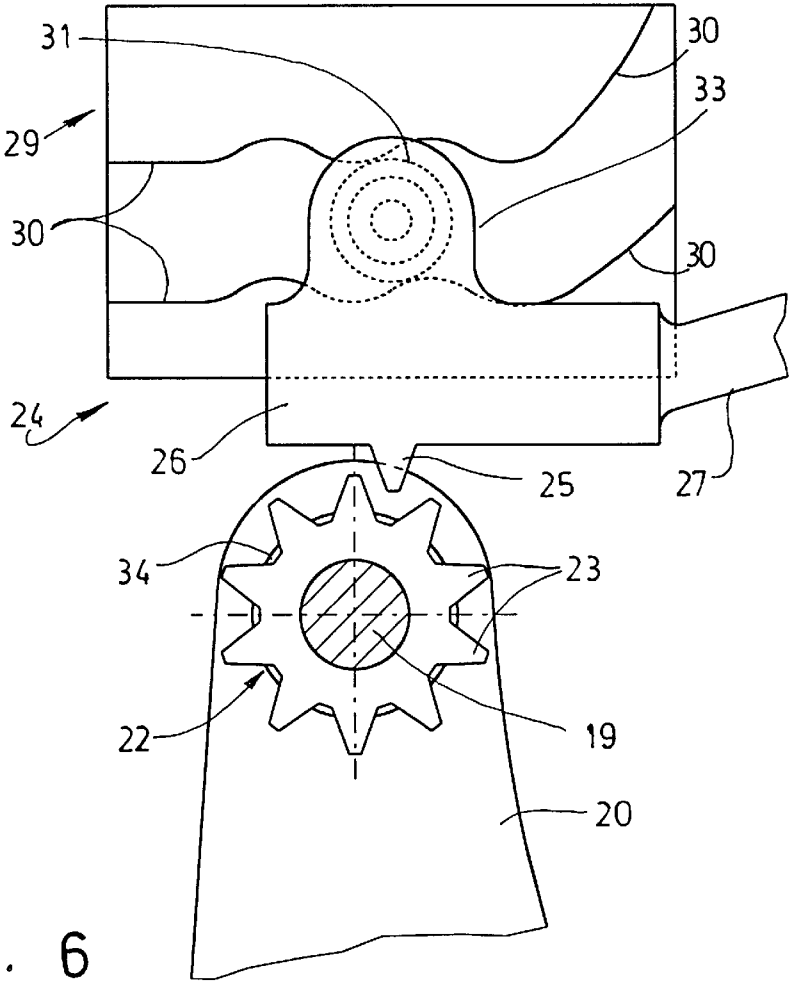

The pressure rod 19 is attached in each case to a pivoting lever 20. These, too, are mounted on the folding turret 11, that is to say rotate with the latter. The pivoting levers 20 move the pressure rods 19 between a retracted initial position for feeding a blank 14 and a press-down position, in which the pressure rod 19, together with the blank, bears on the side wall 18 of the folding mandrel 15 (FIG. 4). As is evident from FIG. 2, the pressure rod 19 is in the retracted position during the take-over of a blank 14 by a folding mandrel 15 and is in a press-down position immediately thereafter.

During the further rotational movement of the folding turret 11, the pressure rod 19 remains in the holding position, until the folding steps are concluded and the other, outer blank is supplied, specifically in the region of the blank station 17. In good time beforehand, the pressure rod 19 is moved into a retracted position as a result of a corresponding movement of the pivoting lever 20, so that the other blank can be supplied. The pressure rod 19 thereafter returns to the holding position again, bearing on the folding mandrel 15.

The pressure rod 19 is designed in a special way, specifically it is provided with a plurality of elastic pressure bodies arranged at an axial distance from one another. These are, in the present case, circular or cylindrical rings 21. They consist preferably of rubber and are fastened to the pressure rod 19 by being vulcanized on. In the press-down position (FIG. 4), the elastic rings 21 bear on the blank 14 (on the outside) and press the latter onto the folding mandrel 15, specifically onto its side wall 18. During this press-down operation, the elastic rings 21 are deformed, specifically flattened so as to form a pressure surface (FIG. 4).

The multiplicity of work cycles resulting from the high performance of packaging machines of this type leads to wearing stress on the pressure rod 19, specifically, in particular, on the rings 21. During each press-down stroke, these rings are exposed to wearing stress in the region in which they bear on the blank 14 or on the folding mandrel 15. After a lengthy operating period, this wearing stress leads to an undesirable change in the member or in the rings 21.

There is therefore provision for changing the relative position of the pressure member after a definite operating period which is determined preferably empirically. In the present case, the pressure rod 19 is adjusted in the circumferential direction, specifically rotated, through an angle. Another circumferential region of the rings 21 thereby comes into a position adjacent to the folding mandrel 15. This "new" circumferential region then becomes the press-down region of the rings 21 on the folding mandrel 15.

In order to execute this regulating movement, the pressure rod 19 is mounted rotatably in or on the pivoting lever 20. The rotational movement through an amount of angle is carried out by means of a mechanical gear which acts on a gearwheel 22 attached to the pressure rod 19. The gearwheel 22 is mounted directly next to the pivoting lever 20 on the pressure rod 19 and is connected non-rotatably to the latter. A rotational movement of the gearwheel 22 causes a corresponding rotational movement of the pressure rod 19 together with the rings 21. As an example, a movement stroke of 36° may be provided. In this example, the gearwheel 22 is designed in such a way that ten teeth 23 are arranged along the circumference. The teeth 23 are designed with sharply converging tooth flanks. After an operating period of, for example, 500 hours, the gearwheel 22 is advanced, specifically by one tooth 23, that is to say by 36°.

In order to adjust the pressure rod 19 or the gearwheel 22, a regulating gear 24 is provided, which is arranged at a fixed location outside the range of movement of the folding turret 11 or of the folding mandrels 15. As is evident from FIG. 2, the regulating gear 24 is mounted after the second blank station 17 positioned in the upper region of the folding turret 11.

In order to carry out a regulating step, the regulating gear 24 brings an (individual) shift tooth 25 into engagement with the gearwheel 22. In this case, the shift tooth 25 is first moved out of an upper, retracted position, outside the range of movement of the gearwheel 22, nearer to the latter as a result of a downward movement or of an approximate radial movement in relation to the said gearwheel, so that the shift tooth 25 penetrates into the region between two adjacent teeth 23. By means of an approximate tangential movement, the shift tooth 25 then brings about the limited rotational movement of the gearwheel 22, specifically by the amount of one tooth 23. The shift tooth 25 is subsequently retracted into an initial position distant from the gearwheel 22.

For this purpose, the shift tooth 25 is attached to the free side of a slide head 26. The slide head 26, in turn, is fastened to the free end of a piston rod 27 of a pressure-medium cylinder 28. In order to actuate the regulating gear 24, the piston rod 27 is extended by means of the pressure-medium cylinder 28.

In order to move the shift tooth 25 into and out of engagement with the gearwheel 22, the slide head 26 is connected to a guide 29 of the regulating gear 24. Integrally formed in a guide body is a slot 30, designed as a groove, in which a tracer roller 31 connected to the slide head 26 runs during the reciprocating movements of the latter. The tracer roller 31 is rotatably connected via a transversely directed journal 32 to the slide head 26, specifically to a laterally attached extension 33.

The groove or slot 30 in the guide 29 is designed in such a way that, during an extending movement of the piston rod 27 and a corresponding movement of the slide head 26, the latter is first guided out of a radially retracted position up to the gearwheel and the shift tooth 25 then penetrates into the region between two teeth 23. Transverse displacement or an approximate tangential movement then takes place, causing the actual shifting stroke.

The adjustment of the pressure member, here the pressure rod 19, is expediently carried out during a temporary interruption in the operation of the packaging machine, specifically while the packaging machine is running empty, that is to say when the (remaining) packs are conveyed out of the packaging machine in succession. Standstill phases of the folding turret occur at this time. During these, the regulating movement can be carried out for each pressure member or for each pressure rod 19. When the packaging machine is started up again, the pressure rod thereby operates with a region of the rings 21 which is free of wear.

Figure 5:
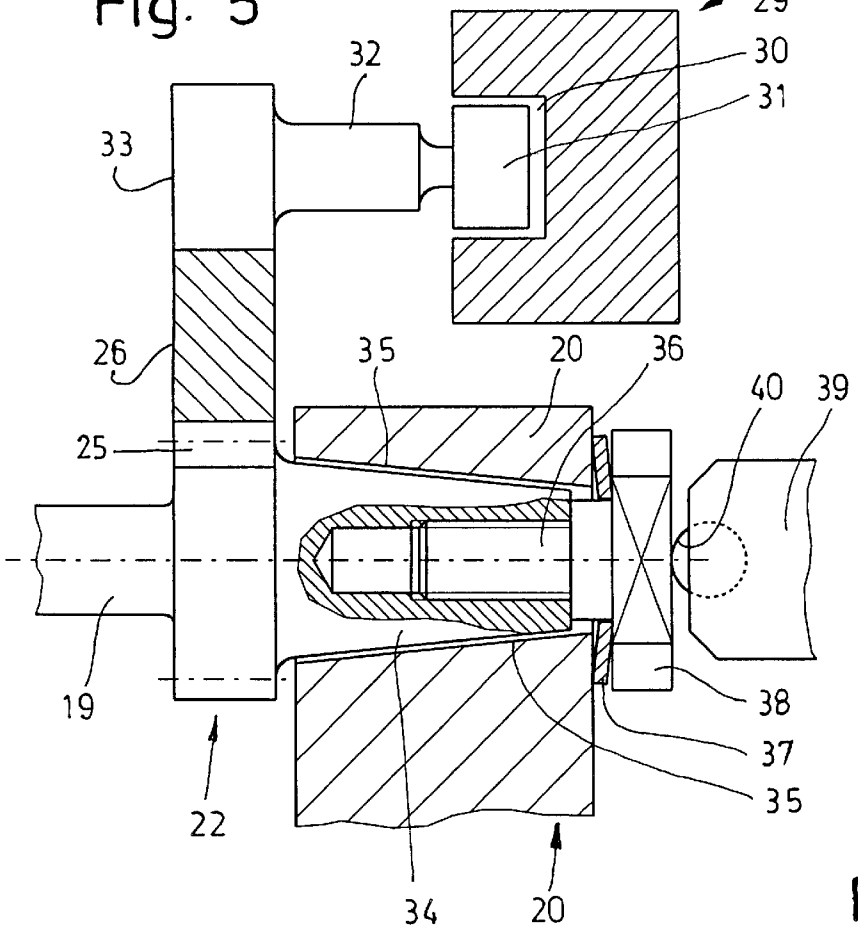

The pressure member, specifically the pressure rod 19, is mounted in a special way at a free end in a holding device or in or on the pivoting lever 20 (FIG. 5). For this purpose, a free end of the pressure rod 19, the said free end being adjacent to the gearwheel 22, is designed as a cone 34. This cone 34 forms a bearing body for the pressure rod 19 in a corresponding, here likewise conical bearing lug 35 of the pivoting lever 20.

While the packaging machine or pressure rod 19 is in operation, the latter is attached non-rotatably to the pivoting lever 20, in the present case by means of a corresponding mounting of the cone 34 in the bearing lug 35. Rotation-free mounting is achieved by exerting an axial tensile force on the bearing body of the pressure rod 19, specifically on the cone 34, so that the outer (conical) bearing face of the cone 34 bears under tension on the likewise conical bearing face of the bearing lug 35. The axially directed tension is induced by a screw bolt 36 which penetrates into the cone 34 centrally from the free side in the axial direction and is braced on the pivoting lever 20 outside the said cone or outside the bearing lug 35. The screw bolt 36 exerts an elastic tensile force on the cone 34.

In the present case, the bolt tensile force of the screw bolt 36 is generated by a spring acting in the axial direction, specifically by a prestressed cup spring 37. The latter is supported, on the one hand, on a side face of the pivoting lever 20 and, on the other hand, on a abutment 38 at the end of the screw bolt 36. The cup spring 37 accordingly presses the cone 34 against or into the bearing lug 35. In this case, the abutment 38 acts in the same way as a widened screw head.

When a movement to regulate the pressure member, specifically the pressure rod 19, is carried out, guiding and centring positioning in the bearing lug 35 of the pivoting lever 20 is temporarily released. For this purpose, a thrust member is provided, which is actuated by means of a pressure-medium cylinder, not shown, on the machine in the region of the regulating gear 24. FIG. 5 shows a thrust head 39 of this actuating member. The thrust head 39 can be moved in the axial direction of the pressure rod 19 in order to release the fixture. As a result, the screw bolt 36, together with the cone 34, is displaced in the axial direction counter to the pressure of the spring 37, so that the cone 34 is released from bearing contact on the bearing lug 35. The pressure rod 19 can then be rotated in the way described.

In the present exemplary embodiment, the thrust head 39 is provided with a hardened ball 40 as a member bearing on the screw bolt 36 or on the abutment 38. The ball 40 comes to bear centrally on the abutment 38 and thus brings about tilt-free displacement. In this case, in order to release the cone 34, it is merely necessary for a slight axial movement to be executed.

The adjustment of the (movable) member, that is to say, in particular, of the pressure rod 19, in order to change the regions subjected to wear may also be carried out by hand. In the exemplary embodiment shown, a tool, for example a spanner, may be applied in the region of the correspondingly designed abutment 38.

What is claimed is:

1. An apparatus, for manufacturing packs, having a plurality of movable holding members which are exposed to mechanical wearing stress on one part region, said apparatus comprising adjusting means for adjusting at least one movable holding member from time to time in such a way that a second part region of the movable holding member is exposed to the wearing stress, wherein the movable holding member is a pressure rod (19); and wherein, after an adjustable number of cycles or operating period, the pressure rod (19), for holding blanks (14) on a pack content or on a folding aid (15), is adjusted in such a way that said second part region of the pressure rod (19) serves as a pressure region or pressure surface.

2. The apparatus according to claim 1, wherein the pressure rod (19) is releasably connected to a holding device in order to execute regulating movements.

3. The apparatus according to claim 2, wherein the pressure rod has a longitudinal axis said apparatus further comprising a plurality of rings (21), arranged at an axial distance from one another and consisting of elastic material, which are arranged as pressure regions on the pressure rod (19), the rings (21) being rotatable through an angle of rotation in order to change the pressure regions.

4. The apparatus according to claim 1, wherein the pressure rod (19), exposed to wearing stress, is adjusted by means of a regulating gear (24) in such a way that different part regions of the pressure rod are successively exposed to wearing stresses.

5. The apparatus according to claim 4, wherein the regulating gear (24) has a movable coupling member for temporarily connecting the regulating gear to the pressure rod (19), the coupling member being a movable shift tooth (25) which, in order to adjust the pressure rod (19), is brought into engagement with a gearwheel (22) attached to the pressure rod (19).

6. The apparatus according to claim 5, wherein the gearwheel (22) is fastened on the pressure rod (19), and the shift tooth (25) can be moved into engagement with the gearwheel (22) from outside, approximately in the radial direction, and can then be moved by the amount of one tooth (23) in the direction of a rotational movement of the gearwheel (22).

7. The apparatus according to claim 6, wherein the shift tooth (25) is attached as a coupling member to a slide head (26) which can be moved by means of a pressure-medium cylinder (28), and the movement of which is predetermined by a mechanical guide (29).

8. The apparatus according to claim 1, further comprising a plurality of folding mandrels (15), each with a said pressure rod (19), which are arranged on a folding turret (11) for the manufacture of cigarette packs (10), all the pressure rods (19) of the folding turret (11) being adjusted by means of a common regulating gear (24) which is positioned outside a path of movement of the folding turret (11), and which can be advanced towards said path of movement in order to adjust the pressure rod (19).

9. The apparatus according to claim 2, wherein the holding device is a pivoting lever, and wherein the pressure rod (19) is fixed at one end to the pivoting lever (20) by means of a coupling which can be released in order to execute the regulating movements.

10. The apparatus according to claim 9, wherein the pressure rod (19) has a free end which is designed as a cone (34), which is mounted in a matched conical bearing lug (35) of the pivoting lever (20), and which is fixed by being pressed onto bearing faces of the bearing lug (35).

11. A packaging machine, for manufacturing packs, comprising a member having a first subregion which is exposed to mechanical wearing stress during operation of the machine, wherein the member is a movable pressure-exerting element which transfers pressure to a counter-member in a cyclical manner, said machine further comprising adjusting means for adjusting the pressure-exerting element from time to time in such a way that a second subregion of the pressure-exerting element is exposed to the wearing stress by abutment on the counter-member during operation of the machine.

12. The packaging machine according to claim 11, wherein the movable pressure-exerting element is a pressure rod (19) for holding blanks (14) on a pack content or on a folding aid or folding mandrel (15), and wherein, after an adjustable number of operating cycles, the pressure rod (19) is adjusted by said adjusting means so that said second sub-region of the pressure rod (19) is exposed to the wearing stress.

* * * * *